US005880083A

United States Patent [19]

Beaujean et al.

[11] Patent Number: 5,880,083

[45] Date of Patent: Mar. 9, 1999

[54] LIQUID BLEACH-CONTAINING FORMULATION FOR WASHING OR CLEANING

[75] Inventors: Hans-Josef Beaujean, Dormagen; Christian Block, Cologne; Rainer Hofmann, Duesseldorf; Dieter Legel, Solingen; Rudolf Lind, Duesseldorf; Josef Penninger, Hilden; Bernd Richter, Leichlingen; Reiner Schackmann, Langenfeld; Karl Schwadtke, Leverkusen, all of Germany

[73] Assignee: Henkel Kommanditgesellschaft auf Aktien, Duesseldorf, Germany

[21] Appl. No.: 776,682

[22] PCT Filed: Aug. 7, 1995

[86] PCT No.: PCT/EP95/03124

§ 371 Date: Feb. 14, 1997

§ 102(e) Date: Feb. 14, 1997

[87] PCT Pub. No.: WO96/05284

PCT Pub. Date: Feb. 22, 1996

[30] Foreign Application Priority Data

Aug. 16, 1994 [DE] Germany ..... 44 28 958.8
Oct. 11, 1994 [DE] Germany ..... 44 36 151.3

[51] Int. Cl.[6] ..... C11D 3/395; C11D 7/18; C11D 7/54; C11D 17/00

[52] U.S. Cl. ..... 510/371; 510/372; 510/378; 510/427; 510/434; 252/186.43; 8/111

[58] Field of Search ..... 510/304, 338, 510/367, 371, 372, 378, 407, 414, 427, 434; 252/186.43; 8/111

[56] References Cited

U.S. PATENT DOCUMENTS

| | | | |
|---|---|---|---|
| 3,479,212 | 11/1969 | Robertson et al. | 117/138.8 |
| 3,709,838 | 1/1973 | Mausner et al. | 252/545 |
| 4,316,812 | 2/1982 | Hancock et al. | 252/99 |
| 4,655,954 | 4/1987 | Broze et al. | 252/102 |
| 4,664,839 | 5/1987 | Rieck | 252/175 |
| 4,737,306 | 4/1988 | Wichelhaus et al. | 252/95 |
| 4,820,439 | 4/1989 | Rieck | 252/135 |
| 4,846,992 | 7/1989 | Fonsny | 252/90 |
| 4,929,380 | 5/1990 | Schulz et al. | 252/121 |
| 5,362,413 | 11/1994 | Kaufmann et al. | 252/174 |
| 5,518,645 | 5/1996 | Beaujean et al. | 252/108 |

FOREIGN PATENT DOCUMENTS

| | | |
|---|---|---|
| 9 81 141 | 1/1976 | Canada . |
| 0 026 529 | 4/1981 | European Pat. Off. . |
| 030 096 | 6/1981 | European Pat. Off. . |
| 158464 | 10/1985 | European Pat. Off. . |
| 164 514 | 12/1985 | European Pat. Off. . |
| 460 810 | 12/1991 | European Pat. Off. . |
| 23 34 899 | 1/1974 | Germany . |
| 35 26 405 | 2/1987 | Germany . |
| 36 26 572 | 2/1987 | Germany . |
| 58/217 598 | 12/1983 | Japan . |
| 2 195 649 | 4/1988 | United Kingdom . |
| WO 90/13533 | 11/1990 | WIPO . |
| WO 92/02610 | 2/1992 | WIPO . |
| WO 93/23521 | 11/1993 | WIPO . |
| WO 94/01524 | 1/1994 | WIPO . |

*Primary Examiner*—Paul Lieberman
*Assistant Examiner*—John M. Petruncio
*Attorney, Agent, or Firm*—Wayne C. Jaeschke; Glenn E. J. Murphy; Henry E. Millson, Jr.

[57] ABSTRACT

A substantially non-aqueous, free-flowing, storable liquid washing or cleaning formulation comprising:

A) from more than 20 to less than 78% by weight of at least one nonionic surfactant;

B) from 0.1 to 25% by weight of at least one anionic surfactant;

C) from 1 to less than 20% by weight of at least one water-soluble builder; and

D) from more than 20 to 35% by weight of at least one bleaching agent.

19 Claims, No Drawings

LIQUID BLEACH-CONTAINING FORMULATION FOR WASHING OR CLEANING

BACKGROUND OF THE INVENTION

1. Field of the Invention

This invention relates to a non-aqueous bleach-containing formulation for washing or cleaning which, besides the bleaching agent, contains nonionic and anionic surfactants and also builders and to a process for the production of this formulation.

2. Statement of Related Art

Water-based washing and cleaning formulations generally contain anionic and nonionic surfactants. However, it has been found to be extremely difficult to incorporate bleaching systems in such formulations. In practice, therefore, bleaching systems are often not used in formulations of the type in question which results in a reduction in their washing performance against bleachable soils. Some liquid detergents available on the market contain very special bleaching systems which, unfortunately, either have very low oxidation potentials or are unstable and decompose even after only brief storage so that there is no improvement in washing activity against bleachable soils.

Various liquid detergent compositions which may contain bleaching agents are described in the literature.

European patent application 30 096, for example, describes non-aqueous liquid detergents of liquid nonionic surfactants which may contain 20 to 70% by weight of builders and 1 to 20% by weight of bleaching agents in suspended form. If desired, these detergents may contain anionic surfactants, such as alkyl benzene sulfonates, olefin sulfonates, alkyl sulfates or soap, optical brighteners, dyes, fragrances or enzymes.

EP-B-0 460 810 describes a non-aqueous liquid dishwashing detergent which contains a non-aqueous organic carrier liquid and at least one component selected from organic cleaning agents, builders, foam inhibitors and mixtures thereof and one component selected from a non-abrasive quantity of 0.5 to 10% of small substantially water-insoluble particles of silicon dioxide, aluminium oxide or titanium oxide or mixtures thereof as anti-film forming agents. The described detergent may also contain 3 to 15% by weight of bleaching agent.

WO 94/01524 describes a substantially non-aqueous liquid detergent which, besides nonionic surfactant, contains up to 60% by weight of builder and between 5 and 35% by weight of bleaching agent. The liquid detergent composition described in this document additionally contains a polymer compound which reduces the viscosity of the dispersion of the solid builders and bleaching agents in the nonionic surfactant in order to obtain a free-flowing and pourable composition.

German patent application 36 26 572 describes a liquid detergent containing a builder, more particularly polyacetal carboxylate, an anti-geling agent and an anti-sedimentation agent dispersed in a liquid nonionic surfactant.

Storable bleach-containing liquid detergents can only be obtained when the bleaching agent is present in the form of a stable dispersion. Commercially available liquid detergents known from the documents cited above have the disadvantage that further auxiliaries are required to obtain a stable dispersion. Since the dispersion present in commercial liquid detergents is limited in its stability, bleaching agents and enzymes cannot be incorporated alongside one another in these products because the enzymes are destroyed by the bleaching agent.

Another problem known from the prior art is that liquid detergents tend to gel, particularly when they are stored at low temperatures or are used at low washing temperatures. The effect of gelation is that the liquid detergents show poor solubility so that, on the one hand, their washing power is affected and, on the other hand, the detergent cannot be completely emptied from the dispensing compartment or a typical dispensing aid while the washing machine is in operation. The gel is very difficult to redisperse in the detergent composition. In addition, gelation leads to a distinct increase in viscosity which in turn affects the dispensing behavior of the liquid detergent. On the other hand, the viscosity of the liquid detergent should not be too low in order to prevent sedimentation of its solid constituents.

DESCRIPTION OF THE INVENTION

The production of bleach-containing liquid washing or cleaning formulations represents another difficulty. In general, stable dispersions of solid particles in the liquid phase are only obtained when the solid particles have a small particle size and a narrow particle size distribution. In view of the different production processes involved, the particle sizes of the builder particles and the bleach particles are very different which leads to a very broad particle size distribution. Large-diameter solid particles in particular lead to unstable dispersions.

The problem addressed by the present invention was to provide a stable bleach-containing liquid washing and cleaning formulation which would contain the solid bleaching agents in the form of a stable dispersion, even when stored for prolonged periods, without any adverse effect on the activity of the substances present therein and which could also contain components sensitive to bleaching agents. Another problem addressed by the present invention was to provide a process for the production of such formulations.

Accordingly, the present invention relates to a non-aqueous liquid or washing or cleaning formulation which contains more than 20 to less than 78% by weight of nonionic surfactants, 0.1 to 25% by weight of anionic surfactants, 1 to less than 20% by weight of water-soluble builders and more than 20 to 35% by weight of bleaching agents.

It has surprisingly been found that the formulation according to the invention contains a special combination of washing- or cleaning-active components so that the invention a provides a free-flowing, storable liquid washing and cleaning formulation which consists almost exclusively of active substance. Tests have shown that, by using soluble builders, the traces of water introduced through the raw materials can be bound so that the bleaching system and also the enzymes and/or soil-repelling polymers, if any, can be stabilized. The anionic surfactants present in accordance with the invention can also contribute towards better dispersion of the bleaching agents. It has been found that, in particular, the fatty alkyl sulfate added in accordance with the invention and/or the fatty acid soap ensure that a stable matrix can be built up for the dispersion of the bleaching system. In contrast to the polymers described in the prior art, which are used as stabilizers for the bleaching system, the fatty acid monoesters and/or soaps used contribute towards the washing performance of the formulation.

It has also been found that the soluble builders can reduce the above-described gelation often observed in liquid or washing or cleaning formulations and can reduce the yield point and the zero shear viscosity. This improves the solubility of the formulation according to the invention which leads to an overall improvement in its washing or cleaning performance. It has also been found that soluble builders contribute less than insoluble zeolites or phosphates towards increasing the viscosity of the washing or cleaning formulation so that larger quantities of solid bleaching agent can be incorporated. On the other hand, the zero shear viscosity of the formulations according to the invention is still high enough to prevent sedimentation of the solid particles.

The present invention also relates to a process for the production of a non-aqueous liquid washing or cleaning formulation containing more than 20 to less than 78% by weight of nonionic surfactants, 0.1 to 25% by weight of anionic surfactants, 1 to less than 20% by weight of water-soluble builder and more than 20 to 35% by weight of bleaching agents, characterized in that the solids present or partial amounts thereof are premixed with the nonionic surfactants or partial amounts thereof and ground in such a way that the temperature of the mixture does not exceed 45° C.

It has surprisingly been found that, in the practical application of the process according to the invention, the solid particles to be used, such as builder and bleaching agent, may be used in virtually any particle size distribution and that the mixture can be obtained in the form of a stable dispersion after grinding. In order to minimize the exposure of the components to heat, the temperature of the mixture should not exceed 35° C.

The expression "non-aqueous" in the context of the invention means that the formulation preferably does not contain any free water which is not bound as water of crystallization or in comparable form in order to prevent decomposition of the peroxide bleaching agent. In some cases, small quantities of free water, more particularly quantities of up to 5% by weight, are tolerable, in which case the ratio of bleaching agent to free water should be at least 3:1.

The formulation according to the invention contains more than 20% by weight to less than 78% by weight and preferably 30% by weight to 60% by weight of nonionic surfactants. Preferred nonionic surfactants are alkoxylated, more particularly ethoxylated or ethoxylated and propoxylated, fatty acid alkyl esters, preferably containing 1 to 4 carbon atoms in the alkyl chain, more particularly the fatty acid methyl esters which are described, for example, in Japanese patent application JP 58/217598 or which are preferably produced by the process described in International patent application WO-A-90/13533.

Other suitable nonionic surfactants are liquid, alkoxylated, preferably ethoxylated, alcohols, more especially primary alcohols, preferably containing 8 to 18 carbon atoms (alkyl polyglycol ethers) and an average of 1 to 12 moles of ethylene oxide (EO) per mole of alcohol in which the alcohol radical may be linear or 2-methyl-branched or may contain linear and methyl-branched radicals in the form of the mixtures typically present in oxoalcohol radicals. However, particularly preferred nonionic surfactants of this type are alcohol ethoxylates containing linear radicals of alcohols of native origin with 8 to 18 carbon atoms, for example coconut fatty alcohol, tallow fatty alcohol or oleyl alcohol, which may contain on average 2 to 8 EO units per molecule. Preferred ethoxylated alcohols include, for example, $C_{12-14}$ alcohols containing 3 EO units or 7 EO units, $C_{9-11}$ alcohols containing 3 EO units, 5 EO units or 7 EO units, $C_{11-15}$ alcohols containing 5 EO units or 7 EO units and mixtures thereof, such as mixtures of $C_{12-14}$ alcohol containing 3 EO units and $C_{12-18}$ alcohol containing 5 EO units. The degrees of ethoxylation mentioned are statistical mean values which may be a whole number or a broken number for a particular product. Preferred alcohol alkoxylates have a narrow homolog distribution (narrow range ethoxylates, NRE).

The formulation according to the invention may contain alkyl polyglycosides, fatty acid alkyl esters or polyhydroxy-fatty acid amides as further nonionic surfactants.

In addition, the formulation according to the invention contains 0.5 to 25% by weight, preferably 1 to 15% by weight and more preferably 4 to 12% by weight of anionic surfactants. $C_{6-22}$ alkyl sulfates, $C_{8-18}$ alkane sulfonates, alkyl benzene sulfonates and/or fatty acid soaps are preferably used. Suitable alkyl sulfates are, in particular, the sulfuric acid monoesters of $C_{6-18}$ fatty alcohols, such as octyl, lauryl, myristyl, cetyl or stearyl alcohol, or the fatty alcohol mixtures obtained from coconut oil, palm oil and palm kernel oil which may additionally contain unsaturated alcohols, for example oleyl alcohol.

Preferred surfactants of the sulfonate type are $C_{9-13}$ alkyl benzene sulfonates, $C_{8-18}$ alkane sulfonates, olefin sulfonates, i.e. mixtures of alkene and hydroxyalkane sulfonates, and disulfonates which are obtained, for example, from $C_{12-18}$ alkanes or $C_{12-18}$ monoolefins with a terminal or internal double bond by sulfonation with gaseous sulfur trioxide and subsequent alkaline or acidic hydrolysis of the sulfonation products.

Suitable soaps, which are included among the anionic surfactants in the context of the present invention, are in particular saturated fatty acid soaps, the salts of lauric acid, myristic acid, palmitic acid or stearic acid and soap mixtures derived in particular from natural fatty acids, for example caproic acid, caprylic acid, cocofatty acid, palm kernel fatty acid or tallow fatty acid.

The formulation according to the invention may contain $C_{6-18}$ alkyl polyglycol ether sulfonates, glycerol ether sulfonates, glycerol ether sulfates, hydroxy mixed ether sulfates, monoglyceride sulfates, sulfosuccinates, sulfotriglycerides, amido acids, $C_{6-18}$ fatty acid amide ether sulfates, $C_{6-18}$ alkyl carboxylates, fatty acid isethionates, N-$C_{6-16}$-acyl sarcosinates, N-$C_{6-18}$-acyl taurides, $C_{6-18}$ alkyl oligoglycoside sulfates, $C_{6-18}$ alkyl phosphates and mixtures thereof as further anionic surfactants.

Sulfuric acid monoesters and the soaps may be present in the formulation according to the invention either individually or in the form of mixtures, for example in a total quantity of 1 to 15% by weight and, more particularly, 1 to 10% by weight.

In one preferred embodiment, the formulation according to the invention does not contain any other anionic surfactants than the soaps.

In addition, the formulation according to the invention contains 1 to less than 20% by weight and preferably 8 to less than 20% by weight of water-soluble builders. Suitable builders are any water-soluble organic and inorganic builders. Useful organic builders are, for example, mono- and/or polycarboxylates, preferably the polycarboxylic acids used in the form of their sodium salts, such as citric acid, adipic acid, succinic acid, glutaric acid, tartaric acid, sugar acids, aminocarboxylic acids, nitrilotriacetic acid (NTA), providing its use is not objectionable on ecological grounds, and mixtures thereof. Particularly preferred salts are the salts of polycarboxylic acids, such as citric acid, adipic acid, succinic acid, glutaric acid, tartaric acid, sugar acids and mixtures thereof, sodium citrate being particularly preferred. Suitable inorganic builders are, in particular, crystalline layer-form sodium silicates corresponding to general formula (I) $NaMSi_xO_{2x+1}.yH_2O$, in which M is sodium or hydrogen, x is a number of 1.9 to 4 and y is a number of 0 to 20, preferred values for x being 2, 3 or 4. Corresponding crystalline layer silicates are described, for example, in European patent application 164 514. Preferred crystalline layer silicates corresponding to formula (I) are those in which M is sodium and x assumes a value of 2 or 3. Both β- and δ-sodium disilicates $Na_2Si_2O_5.yH_2O$ are particularly preferred.

In addition, layer silicates of natural and synthetic origin may be used. Layer silicates such as these are known, for example, from patent applications DE-B-23 34 899, EP-A-0 026 529 and DE-A-35 26 405. Their suitability is not confined to a particular composition or structural formula. However, smectites, especially bentonites, are preferred.

Other suitable builders are, for example, amorphous silicates with a low water content, preferably with a water content below 15% by weight, and silicates in the form of compounds, for example soda/silicate compounds.

In one preferred embodiment, the formulation according to the invention contains as builder a mixture of mono- and/or polycarboxylates and crystalline layer-form sodium silicates corresponding to general formula (I) $NaMSi_xO_{2x+1}.yH_2O$, in which M is sodium or hydrogen, x is a number of 1.9 to 4 and y is a number of 0 to 20, preferred values for x being 2, 3 or 4, and/or amorphous silicates. The mono- and/or polycarboxylates and the crystalline layer silicates are present in a ratio of preferably 4:1 to 1:4, more preferably 3:1 to 1:3 and most preferably 1.2:1 to 1:1.2.

The formulation according to the invention contains bleaching agents in a quantity of more than 20 to 35% by weight and preferably in a quantity of more than 20 to 30% by weight. Among the compounds yielding $H_2O_2$ in water which are used as bleaching agents, the sodium borates, particularly sodium perborate tetrahydrate and sodium perborate monohydrate, are particularly important. Other suitable bleaching agents are, for example, sodium percarbonate, peroxypyrophosphates, citrate perhydrates and $H_2O_2$-yielding peracidic salts or peracids, such as perbenzoates, peroxophthalates, diperazelaic acid or diperdodecanedioic acid.

To ensure stable dispersion of the solids in the formulation according to the invention, the solids present, for example the builders and the bleaching agent, preferably have such a particle size distribution that at least 90% of the particles are smaller than 15 μm and, in particular, smaller than 10 μm and at most 75% and, in particular, 70% of the particles are smaller than 5 μm.

In order to obtain an improved bleaching effect where washing is carried out at temperatures of 60° C. or lower, bleach activators may be incorporated in the formulations according to the invention. Examples of bleach activators are the N-acyl or O-acyl compounds which form organic peracids with $H_2O_2$, preferably N,N'-tetraacylated diamines, also carboxylic anhydrides and esters of polyols, such as glucose pentaacetate. The content of bleach activators in the bleach-containing formulations is in the usual range, preferably from 1 to 10% by weight and more preferably from 3 to 8% byweight. Particularly preferred bleach activators are N,N,N',N'-tetraacetyl ethylenediamine (TAED) and 1,5-diacetyl-2,4-dioxohexahydro-1,3,5-triazine (DAHT).

In one preferred embodiment, the formulation according to the invention contains enzymes. The enzyme content of the formulation may be from 0.2 to 4% by weight. Suitable enzymes are those from the class of proteases, lipases, amylases and cellulases or mixtures thereof. Particularly suitable enzymes are the enzymes obtained from bacterial strains or fungi, such as Bacillus subtilis, Bacillus licheniformis and Streptomyces griseus. The enzymes may be adsorbed to supports and/or encapsulated in shell-forming substances in known manner.

The formulation according to the invention may additionally contain stabilizers for the enzymes. The stabilizers used, which are also suitable as stabilizers for per compounds, may be selected from the salts of polyphosphonic acids, more especially 1-hydroxyethane-1,1-diphosphonic acid (HEDP). The polyphosphonic acids mentioned above are also suitable for binding traces of heavy metal. Suitable heavy metal complexing agents are, for example, the HEDP mentioned above and ethylenetriamine pentamethylene phosphonic acid (DTPMP).

The formulation according to the invention may additionally contain soil-releasing polymers. The soil-releasing polymers are present in quantities of preferably 0.01 to 5% by weight and, more preferably, 0.05% by weight to around 3% by weight. Suitable soil-releasing polymers are, for example, polyethylene oxides having a molecular weight of 3,000 to 600,000.

Preferred soil-releasing polymers are polymers containing ethylene glycol terephthalate groups and polyethylene glycol terephthalate groups which each comprise 17 to 110 ethylene glycol groups, the molar ratio of ethylene glycol terephthalate to polyethylene glycol terephthalate in the polymer being 50:50 to 90:10. In these compounds, the molecular weight of the linking polyethylene glycol units is in the range from 750 to 5,000. The polymers may have an average molecular weight of around 5,000 to around 200,000. The ethylene glycol terephthalate and polyethylene glycol terephthalate may be arbitrarily distributed in the polymer.

Preferred polymers are those with molar ratios of ethylene glycol terephthalate to polyethylene glycol terephthalate of 65:35 to 90:10 and preferably 65:35 to 80:20, the linking polyethylene glycol units having a molecular weight of 750 to 5,000 and preferably 1,000 to 3,000 and the polymer having a molecular weight of 10,000 to 50,000. One example of commercial polymers of this type is the product marketed under the name of "Repel-O-Tex SRP3" by Rhône-Poulenc, France.

The soil-releasing polymers preferably, used may be prepared by known polymerization processes, the starting materials being used in the quantities required to obtain the ratios of ethylene glycol terephthalate to polyethylene glycol terephthalate mentioned above. For example, the process described in U.S. Pat. No. 3,479,212 may be used to produce suitable polymers.

In addition to the builders mentioned above, the formulations according to the invention may contain other inorganic substances. Alkali metal carbonates, for example soda, alkali metal hydrogen carbonates, alkali metal sulfates and phosphates are mentioned as suitable substances in this regard. This additional inorganic material may be present in quantities of up to 10% by weight.

The formulations according to the invention may contain optical brighteners and redeposition inhibitors, foam inhibitors and also dyes and perfumes are further constituents.

The formulations according to the invention preferably have a zero shear viscosity $h_o$ at 20° C. of 100 to 10,000 Pas and preferably 500 to 6,000 Pas and a pseudoplastic flow behavior h on application of 100 to 10,000 mPas and preferably 500 to 4,000 mPas at a shear rate D of 30/s. The yield point $t_F$ at 20° C. is 0.5 to 10 Pa and preferably 1 to 5 Pa.

The formulation according to the invention preferably contains no solvent. In one particularly preferred embodiment, the formulation according to the invention has an active substance content of 100%.

The formulation according to the invention has a pH value of preferably 7 to 11 and more preferably 8.5 to 10.5.

The formulations according to the invention may be used both in detergents and in cleaning products. For example, high-viscosity formulations according to the invention may be used in the commercial cleaning of textiles.

Production process

In the process according to the invention, the solids present or partial amounts thereof are premixed with the nonionic surfactants or partial amounts thereof and ground in such a way that the temperature of the mixture does not exceed 45° C., preferably 40° C. and, more preferably, 35° C. "Partial amount" in the context of this description means part of the total quantity of solids or the total quantity of nonionic liquid surfactants and can also mean the total quantity of an individual component, for example builder or bleaching agent, as part of the total solids or nonionic liquid surfactants. The ground partial amounts and other components, if any, may then be mixed to form the required formulation. In a preferred embodiment, the solid particles of the non-aqueous liquid formulation produced in accordance with the invention have such a particle size distribution that at least 90% of the particles are smaller than 10 μm and at most 70% of the particles are smaller than 5 μm.

In one embodiment, all the components of the formulation according to the invention are premixed to form a mill batch and are then ground to the required particle size distribution in a single pass through a mill. A procedure such as this is particularly advantageous when the solid particles are smaller than 1.0 mm and preferably smaller than 0.8 mm.

If the solids contain particles with a very broad particle size distribution or rather with particles sizes of larger than 1.0 mm, for example enzymes in granular form, the mill batch may either be passed through the same mill several times (discontinuous grinding) or the mixture may be ground to the necessary fineness by multistage grinding involving continuous passage through mills arranged in tandem. In the case of discontinuous grinding, three-pass grinding and, more particularly, two-pass grinding is preferred. In the case of continuous multistage grinding, three and preferably two mills are arranged in tandem.

In both the discontinuous procedure and the continuous procedure, the mixture may be preground in a first grinding step, i.e. in the first pass or in the first stage, to such a particle size that around 90% of the particles are smaller than 100 μm and preferably smaller than 50 μm. The particles may then be ground to the required particle size distribution in one or more additional grinding stages.

In another embodiment of the process according to the invention, the solid particles without enzymes are premixed with a partial amount of the liquid nonionic surfactants while the enzymes are premixed with another partial amount of the liquid nonionic surfactants and separately ground by so-called partial-stream grinding. The mill batches are then mixed to form the required formulation, optionally with other components which have not been ground.

For incorporation in the liquid detergent according to the invention, the enzymes may be used in the form of granules and, more particularly, in the form of a liquid enzyme preparation.

When the individual components of the formulation according to the invention are premixed, a viscous dispersion is obtained. Shear forces inter alia are generated in the grinding of viscous dispersions, increasing the energy density in the dispersion and leading to heating. The heat generated is greater, the stronger the shear forces. The magnitude of the shear forces generated is determined inter alia by the size of the grinding chamber and the level to which it is filled. Heating of the material being ground can be avoided by directly dissipating the heat generated and/or by minimizing the shear forces.

The heat of friction generated can be dissipated in known manner. In one embodiment, the grinding chamber is defined by large cooling surfaces to which the heat generated is given off. The grinding chamber is preferably surrounded by a cooling medium so that the heat generated is given off to the surface of the grinding chamber and is transferred from there to a cooling medium. The transfer of heat is more effective, the higher the thermal conductivity of the material with which the surface of the grinding chamber is lined or the larger the surface of the grinding chamber.

The temperature of the cooling medium generally depends upon the thermal conductivity of the material with which the grinding chamber is lined. The higher the thermal conductivity of the constituent material of the grinding chamber, the higher the temperature of the cooling medium can be. It is important to ensure that the temperature of the cooling medium is not too low. The suspension according to the invention normally has a solidus point of 0° to 15° C. If the temperature of the cooling medium is low, the wall of the grinding chamber is in danger of becoming too cold so that the temperature of the mixture to be ground is locally below the melting point on the surface of the wall of the grinding chamber. This still viscous to solid substance can remain there and form a boundary layer which can impede the dissipation of heat and can lead to unsatisfactory grinding. In addition, the material forming this boundary layer is no longer effectively involved in the grinding process.

In one preferred embodiment, the size of the grinding chamber, the extent to which it is filled with grinding balls, the constituent material of the walls of the grinding chamber and also the nature and temperature of the cooling medium are adapted to one another in such a way that the composition to be ground is reduced to the required particle size distribution in an economically acceptable time or rather at a high throughput without the temperature of the dispersion exceeding 45° C., preferably 40° C. and more preferably 35° C.

The mixture is preferably ground in wet ball mills or roll mills. Stirred ball mills and ring ball mills with a narrow grinding chamber and a large cooling surface are particularly preferred.

The ratio of the drive energy acting on the grinding rotor in these mills to the throughput of mixture to be ground should be greater than 0.001 kWh/kg and is preferably greater than 0.05 kWh/kg and more preferably greater than 0.125 kWh/kg.

The surfaces of those parts of the mills which come into contact with the product should be harder by a reasonable margin than the substances to be ground. Accordingly, suitable materials are, for example, white cast iron, steel, hardened steel and hardened stainless steel. In addition, the various parts of the mill may be coated with hard metals or ceramics such as, for example, aluminium oxide or silicon carbide ceramics.

EXAMPLES

Production of the formulations according to the invention:

The anionic surfactant was dissolved in the nonionic surfactants at 90° C. and then cooled to room temperature. The builders and the bleaching agent and any other components present were then successively added.

The product was then wet-round in a cooled ball mill (zirconium oxide balls, diameter 1.2 to 1.6 mm, maximum temperature ≦35° C.).

The formulations are set out in Table 1 (a and b), the quantities of the individual components being shown in % by weight.

TABLE 1a

| | Example | | | | | |
|---|---|---|---|---|---|---|
| | 1 | 2 | 3 | 4 | 5 | 6 |
| Dehydol ® LT7[1)] | — | 6.5 | 11.3 | 27.0 | 6.3 | 9.0 |
| Dehydol ® LST 80/20[2)] | 19.2 | 17.0 | 20.0 | 21.1 | 17.0 | 19.0 |
| Lutensol ® AO7[3)] | 24.6 | 14.0 | — | — | 14.0 | 16.9 |
| Maranil ® A[4)] | 5.4 | 7.8 | 7.1 | 4.0 | 7.8 | 7.8 |
| Sulfopon ® T[5)] | 1.4 | — | 1.4 | — | — | — |
| Edenor ® HT 35[6)] | — | 0.1 | — | 0.4 | — | — |
| Na Citrate | 15.0 | 13.0 | 9.0 | 16.0 | 13.0 | — |
| SKS-6[7)] | — | 4.0 | 8.0 | — | 4.0 | 13.0 |
| Peroborate monohydrate | 21.0 | 21.0 | 25.0 | 21.0 | 21.0 | 21.0 |
| TAED | 6.0 | 6.0 | 7.0 | 7.3 | 6.0 | 6.0 |
| Triacetin | 4.7 | 4.7 | 4.7 | — | 4.7 | 4.7 |
| Soda | — | 4.0 | 4.0 | — | 4.0 | — |
| VP1132[8)] | 0.2 | 0.2 | 0.2 | 0.2 | 0.2 | 0.2 |
| Turpinal ® 2 NZ[9)] | 0.6 | — | 0.6 | 0.6 | — | — |
| BLAP ® 200[10)] | 1.7 | 1.7 | 1.7 | 1.7 | 1.7 | 2.1 |
| Water | 0.2 | — | — | 0.7 | 0.3 | 0.3 |

TABLE 1b

| | Examples | | |
|---|---|---|---|
| | 7 | 8 | 9 |
| Dehydol 04[11)] | — | — | 15.0 |
| Dehydol 980[12)] | — | 14.2 | 16.3 |
| Dehydol LS 6[13)] | 26.0 | 25.0 | 14.0 |
| APG/soda compound[14)] | 8.0 | 8.0 | — |
| Lutensol AO7 | 13.0 | — | — |
| Maranil A | 4.5 | — | — |
| Octyl Sulfate | 5.0 | 7.0 | 7.0 |
| $C_{18-14}$ fatty acid | 1.0 | 1.0 | 1.0 |
| Na Citrate | 15.0 | 7.0 | 15.0 |
| Sokalan DCS[15)] | — | 10.0 | — |
| Perborate monohydrate | 21.0 | 21.0 | 21.0 |
| TAED | 6.0 | 6.0 | 6.0 |
| Soda | — | — | 4.0 |
| Polyethylene oxide Molecular weight 600.000 | 0.1 | 0.1 | 0.1 |
| Water | 0.4 | 0.7 | 0.6 |

[1)]Dehydol ® LT 7 is an ethoxylated $C_{12-18}$ fatty alcohol containing an average of 7 EO units (a product of Henkel KGaA, Düsseldorf)
[2)]Dehydol ® LST 80/20 is a mixture of 80% of an ethoxylated C12–18 fatty alcohol containing an average of 5 EO units and 20% of an ethoxylated $C_{12-14}$ fatty alcohol containing an average of 3 EO units (a product of Henkel KGaA, Düsseldorf)
[3)]Lutensol ® AO7 is an ethoxylated $C_{12-15}$ oxofatty alcohol containing an average of 7 EO units (a product of BASF, Ludwigshafen)
[4)]Maranil ® A is a $C_{11-13}$ alkyl benzene sulfonate (a product of Hüls AG, Marl)
[5)]Sulfopon ® T is a $C_{16-18}$ fatty alcohol sulfate (a product of Henkel KGaA, Düsseldorf)
[6)]Edenor ® HT 35 is a $C_{16-18}$ fatty acid soap (a product of Henkel KGaA Düsseldorf)
[7)]SKS-6 is a crystalline layer silicate (a product of Hoechst AG, Frankfurt)
[8)]VP 1132 is a silicone oil (a product of Dow Corning)
[9)]Turpinal ®2 NZ is a hydroxy ethyl diphosphonate (a product of Henkel KGaA, Düsseldorf)

TABLE 1b-continued

| | Examples | | |
|---|---|---|---|
| | 7 | 8 | 9 |

[10)]BLAP ® 140 is a protease (a product of Henkel KGaA, Düsseldorf)
[11)]$C_8$ fatty alcohol + 4 moles EO (Henkel KGaA)
[12)]$C_{10-14}$ fatty alcohol + 1 mole PO + 6 moles EO (Henkel KGaA)
[13)]$C_{12-14}$ fatty alcohol + 6 moles EO (Henkel KGaA)
[14)]$C_{12-14}$ alkyl polyglucoside:soda granules (ratio by weight 1:1)
[15)]Mixture of adipic acid, glutaric acid and succinic acid (BASF).

Examples 7 to 9 are suitable both for washing textiles and, in particular, for cleaning hard surfaces.

The rheological data of formulation No. 3 were determined with a Rheometrics RFSII shear-rate-controlled rotational rheometer. The results are set out in Table 2.

The stability of formulations 5 and 6 in storage was tested at room temperature and at 30° C. The results are set out in Table 3.

TABLE 2

| Temperature | 10° C. | 20° C. | 30° C. |
|---|---|---|---|
| Yield point (Pa) | 2.8 | 2.0 | 2.0 |
| Zero shear viscosity | 5900 | 3800 | 3000 (Pas) |
| Viscosity D = 30/s (Pas) | 5.0 | 3.0 | 2.2 |

It can be seen from Table 2 that formulation No. 3 according to the invention shows very good flow properties, the zero shear viscosity still being high enough to prevent the solid particles from sedimenting.

TABLE 3

| | | Example | |
|---|---|---|---|
| | | 5 | 6 |
| Viscosity (Pas) | | 141 | 365 |
| $AO^1$ (%) | | 3.10 | 3.10 |
| Stability in storage at room temperature | | | |
| 1 week | $AO^1$ (%) | 3.04 | 3.10 |
| | intact (%) | 98.1 | 100.0 |
| 8 weeks | $AO^1$ (%) | 2.84 | 2.94 |
| | intact (%) | 91.6 | 94.8 |
| Stability in storage at 30° C. | | | |
| 1 week | $AO^1$ (%) | 3.07 | 3.10 |
| | intact (%) | 99.0 | 100.00 |
| 8 weeks | $AO^1$ (%) | 2.88 | 2.97 |
| | intact (%) | 92.9 | 95.8 |

[1]Active oxygen

Table 3 shows the high stability in storage of formulations 5 and 6 according to the invention over a long period both at room temperature and at elevated temperature.

We claim:

1. A substantially non-aqueous, free-flowing, storable liquid washing or cleaning formulation comprising:

A) from more than 20 to less than 78% by weight of at least one nonionic surfactant;

B) from 0.1 to 4% by weight of at least one anionic surfactant selected from the group consisting of a $C_{6-22}$ alkyl sulfate, a $C_{8-18}$ alkane sulfonate, an alkyl benzene sulfonate and a fatty acid soap;

C) from 1 to less than 20% by weight of at least one water-soluble builder; and

D) from more than 20 to 35% by weight of at least one bleaching agent.

2. The formulation of claim 1 wherein component A) is present in from about 30 to about 60% by weight.

3. The formulation of claim 2 wherein component C) is present in from about 8 to less than 20% by weight.

4. The formulation of claim 3 wherein component D) is present in from more than 20 to about 30% by weight.

5. The formulation of claim 1 wherein component A) is at least one of an alkoxylated fatty acid alkyl ester, an alkoxylated alcohol, an alkyl polyglycoside, a fatty acid alkyl ester or a polyhydroxy-fatty acid amide.

6. The formulation of claim 1 wherein component B) consists of a fatty acid soap.

7. The formulation of claim 1 wherein component C) is at least one mono- or polycarboxylate.

8. The formulation of claim 7 wherein component C) is a salt of a polycarboxylic acid.

9. The formulation of claim 7 wherein component C) also contains at least one of a crystalline layer-form sodium silicate corresponding to the formula $NaMSi_xO_{2x+1}.yH_2O$, in which M is sodium or hydrogen, x is a number of 1.9 to 4 and y is a number of 0 to 20, or an amorphous silicate.

10. The formulation of claim 1 wherein component D) is a salt of a peracid.

11. The formulation of claim 10 wherein the salt of a peracid is sodium perborate.

12. The formulation of claim 1 wherein component D) is present in the form of a stable dispersion in which at least 90% of the dispersed particles are smaller than 15 $\mu$m.

13. The formulation of claim 12 wherein not more than 75% of the dispersed particles are smaller than 5 $\mu$m.

14. The formulation of claim 1 wherein the formulation also contains at least one of a bleach activator, an enzyme, or a soil-releasing polymer.

15. A process for the preparation of the formulation of claim 1 comprising the steps of I) mixing together at least part of the solid components of the formulation with at least part of component A);

II) grinding the resulting mixture while maintaining the temperature thereof at 45° C. or less; and III) mixing the resulting ground mixture with the remaining components of the formulation.

16. The process of claim 15 wherein the temperature in step II) does not exceed 35° C.

17. The process of claim 15 wherein step II) is carried out by passing said resulting mixture through a wet ball mill or a roll mill at least once.

18. The process of claim 17 wherein the wet ball mill is used which is a stirred ball mill with a narrow grinding chamber and a large cooling surface.

19. A process for the preparation of the formulation of claim 1 wherein the formulation also contains at least one enzyme comprising the steps of I) premixing the at least one enzyme with part of component A);

II) mixing together the solid components of the formulation with the remaining part of component A);

III) separately grinding the mixtures from steps I) and II) while maintaining the temperature of each mixture at 45° C. or less; and IV) combining said separately ground mixtures together with the remaining components of the formulation;

wherein steps I) and II) can be carried out in reverse order.

* * * * *